US006322317B1

(12) United States Patent
Schelhorn

(10) Patent No.: US 6,322,317 B1
(45) Date of Patent: Nov. 27, 2001

(54) METHOD FOR FORMING VERTICAL COLUMNS OF TOBACCO IN AN INTERMEDIATE RESERVOIR

(75) Inventor: Fritz Schelhorn, Bayreuth (DE)

(73) Assignee: Brown & Williams on Tobacco Corporation, Louisville, KY (US)

( * ) Notice: Subject to any disclaimer, the term of this patent is extended or adjusted under 35 U.S.C. 154(b) by 0 days.

(21) Appl. No.: 09/669,304

(22) Filed: Sep. 25, 2000

Related U.S. Application Data

(62) Division of application No. 09/186,964, filed on Nov. 5, 1998, now Pat. No. 6,123,447.

(30) Foreign Application Priority Data

Nov. 11, 1997 (DE) ..... 197 49 933

(51) Int. Cl.[7] ..... B65G 47/18; B65G 65/32
(52) U.S. Cl. ..... 414/808; 414/299; 414/300
(58) Field of Search ..... 198/560; 414/299, 414/300, 808

(56) References Cited

U.S. PATENT DOCUMENTS

| | | | | |
|---|---|---|---|---|
| 3,735,881 | * | 5/1973 | Wilding | 414/300 X |
| 3,811,585 | | 5/1974 | Wilding . | |
| 3,879,021 | | 4/1975 | Riley . | |
| 4,027,806 | * | 6/1977 | Weihmuller | 198/371.2 X |
| 4,619,576 | | 10/1986 | George et al. . | |
| 4,725,181 | * | 2/1988 | Mine et al. | 414/268 |
| 5,324,158 | | 6/1994 | Shah et al. . | |

FOREIGN PATENT DOCUMENTS

| | | | | |
|---|---|---|---|---|
| 215326 | * | 10/1909 | (DE) | 414/303 |
| 673308 | | 3/1939 | (DE) . | |
| 2 024 513 | | 12/1971 | (DE) . | |
| 21 25 629 | | 7/1976 | (DE) . | |
| 56145039 | * | 11/1981 | (JP) | 414/299 |

* cited by examiner

*Primary Examiner*—Steven A. Bratlie
(74) *Attorney, Agent, or Firm*—John F. Salazar; Middleton Reutlinger

(57) ABSTRACT

The invention relates to a method and a device for feeding layers of tobacco to an intermediate reservoir, including feeding a continual falling, horizontal shifting stream of tobacco to the intermediate reservoir, the falling stream of tobacco being deflected by web-type separators, below, which predetermined break points form in the tobacco mass in the intermediate reservoir, resulting in vertical columns of tobacco separable from each other, the columns of tobacco separating individually from the tobacco mass and dropping onto a dispensing conveyor.

11 Claims, 2 Drawing Sheets

METHOD FOR FORMING VERTICAL COLUMNS OF TOBACCO IN AN INTERMEDIATE RESERVOIR

REFERENCE TO PRIORITY

This utility patent application is a divisional of U.S. patent application Ser. No. 09/186,964, filed on Nov. 5, 1998, now U.S. Pat. No. 6,123,447 which corresponds to German patent application 197 49 933.3-23, filed Nov. 11, 1997.

BACKGROUND OF THE INVENTION

1. Field of the Invention

The invention relates to a method and a device for feeding layers of tobacco to an intermediate reservoir.

The invention relates more particularly to a method and device for feeding layers of tobacco to a box for cut ribs and stems.

2. Description of the Related Art

Tobacco products, especially cigarettes, are typically composed of many different grades of tobacco and thus for the quality of these tobacco products a consistent fidelity in blend is substantial on the basis of the large amounts of tobacco to be processed in preparing the tobacco, so that each and every cigarette contains a constantly homogenous tobacco blend.

If, for this purpose, a proportion of a certain grade of tobacco necessary for a specific blend were to be fed directly to the blending box from a silo, layers of tobacco would result in the blending box greatly differing in homogeneity to such a degree that the wanted homogeneous quality of the finished tobacco product would be unfavorably influenced.

That is why it is important in satisfying the basic requirement that the large blending boxes as known in the tobacco industry are filled with differing grades of tobacco in such a way that the various grades of tobacco are deposited by layers in such a blending box so that the lengths of the individual layers correspond to the length of the blending box.

Then, from the tobacco mass thus formed, vertical portions are removed containing tobaccos of various layers and thus various grades of tobacco to generate a homogenous blend of tobacco.

Thus, various devices have been developed, intended it assure the consistent stratification in such blending boxes, see e.g. DE 20 24 513 A, U.S. Pat. No. 4,619,576 and U.S. Pat. No. 3,811,585.

A further problem associated with such a blending box is that the tobacco needs to be fed equally apportioned for further processing. For this purpose it is usually such that at the outlet end of the blending box so-called sweeper rakes are installed which acts as rotating spiked shafts and which are provided with spikes to tear the vertical tobacco portions from the face wall of the tobacco mass in the blending box. This allows this particular tobacco to be supplied for further processing. However, discharging the layers of tobacco in this way from the blending box greatly stresses the tobacco, degrading it accordingly. This applies in particular to cut tobaccos having a high moisture content which in critical bulk heights and lengthy storage periods tend to pack and clump so that discharge by means of sweeper rakes results in heavy detriment to qualify.

SUMMARY OF THE INVENTION

The invention is thus based on the object of defining a device and a method for feeding an intermediate reservoir with layers of tobacco in which the aforementioned disadvantages do not occur. More particularly, the object is to define a device and a method permitting by simply designed means the discharge of homogenous tobacco portions from the blending box without quality being detrimented in any way.

This object is achieved by a device for feeding layers of tobacco to an intermediate reservoir, more particularly, to a box for cut ribs and stems, comprising a blending trolley arranged above said intermediate reservoir, said blending trolley being reciprocable in the longitudinal direction of said intermediate reservoir, said blending trolley receiving a continual feed of tobacco and a continual stream of tobacco dropping from the discharge end of said blending trolley downwardly into said intermediate reservoir, a conveyor for the further transport of the tobacco mass present in said intermediate reservoir to a dosing apparatus and web-type separators in the drop path of said tobacco between said blending trolley and said intermediate reservoir for deflecting said dropping stream of tobacco so that predetermined break points form in said tobacco mass under said separators thus forming vertical columns of tobacco separable from each other.

The object is achieved also by a method for feeding layers of tobacco to an intermediate reservoir, more particularly, a box for cut ribs and stems, including feeding a continually falling, horizontally shifting stream of tobacco to said intermediate reservoir, wherein said falling stream of tobacco is deflected by a web-type separators, below said web-type separators predetermined break points form in said tobacco mass in said intermediate reservoir, forming vertical columns of tobacco separable from each other.

There are also further embodiments of the device read from the features as set forth in the dependent claims.

The advantages achieved by the invention are based on the following mode of functioning:

The stream of tobacco falling vertically from a blending trolley in conventional ways and is deflected by web-type separators located above the intermediate reservoir, usually a blending box, so that in the vertical direction under these web-type separators, zones of lesser tobacco density materialize in all tobacco layers in the intermediate reservoir. These zones of lesser density have the effect of being "predetermined break points" in the tobacco mass so that these predetermined break points produce vertical columns of tobacco separated from each other, comprising different layers and thus grades of tobacco.

On discharge of the tobacco mass from the intermediate reservoir the first tobacco column in the discharging direction tilts away and is thus supplied as a sole, separated portion to further processing, for example a dispensing conveyor.

The tobacco mass in the intermediate reservoir is thus subjected to no mechanical agitation whatsoever so that masses of tobacco heavily compacted and tending to lump due to critical bulk heights and lengthy storage may be supplied apportioned to further processing in a gently treated manner.

Particularly in the case of cut rib and stem tobacco processing needs to be done in the presence of a high moisture content, this being the reason why the invention is especially suitable for the application of cut rib and stem tobacco blending bins or silos, also hereinafter termed a "shag box".

Expediently the web-type separators are formed by two strips connected to each other and being A-shaped or steep roof as viewed from the side. The horizontal basic surface area of the roof should have a width of approximately 30 to 200 mm, more particularly 80 to 160 mm, while the height should be in the range of 30 to 120 mm, more particularly 40 to 100 mm. These dimensions of the roof-shaped separators ensure that, on the one hand, predetermined break points materialize of sufficient width, thus making for satisfactory separation of the individual tobacco columns and, on the other, enabling the tobacco to slide downwards on the side surface areas of the separators without sticking thereto.

Experience as shown it to be beneficial if the web-type separators are spaced away from each other by 30 to 60 cm, more particularly 40 to 50 cm, since in this way homogenous tobacco portions, i.e. the aforementioned tobacco columns, may be formed for further processing.

In one preferred embodiment the underside of the outlet end of the blending trolley mounts a blade for sweeping tobacco from the upper surface areas of the web-type separators to prevent tobacco collecting and thus encrusting. The blade may consist of a metal plate which runs past the top edge of the web-type separators slightly spaced away therefrom, or of a deformable material which strokes the surface areas of the web-type separators, thereby sweeping off the tobacco.

BRIEF DESCRIPTION OF THE DRAWINGS

The invention will now be discussed in more detail by way of an example embodiment with reference to the accompanying schematic drawings in which.

DESCRIPTION OF THE PREFERRED EMBODIMENTS

Figure 1:
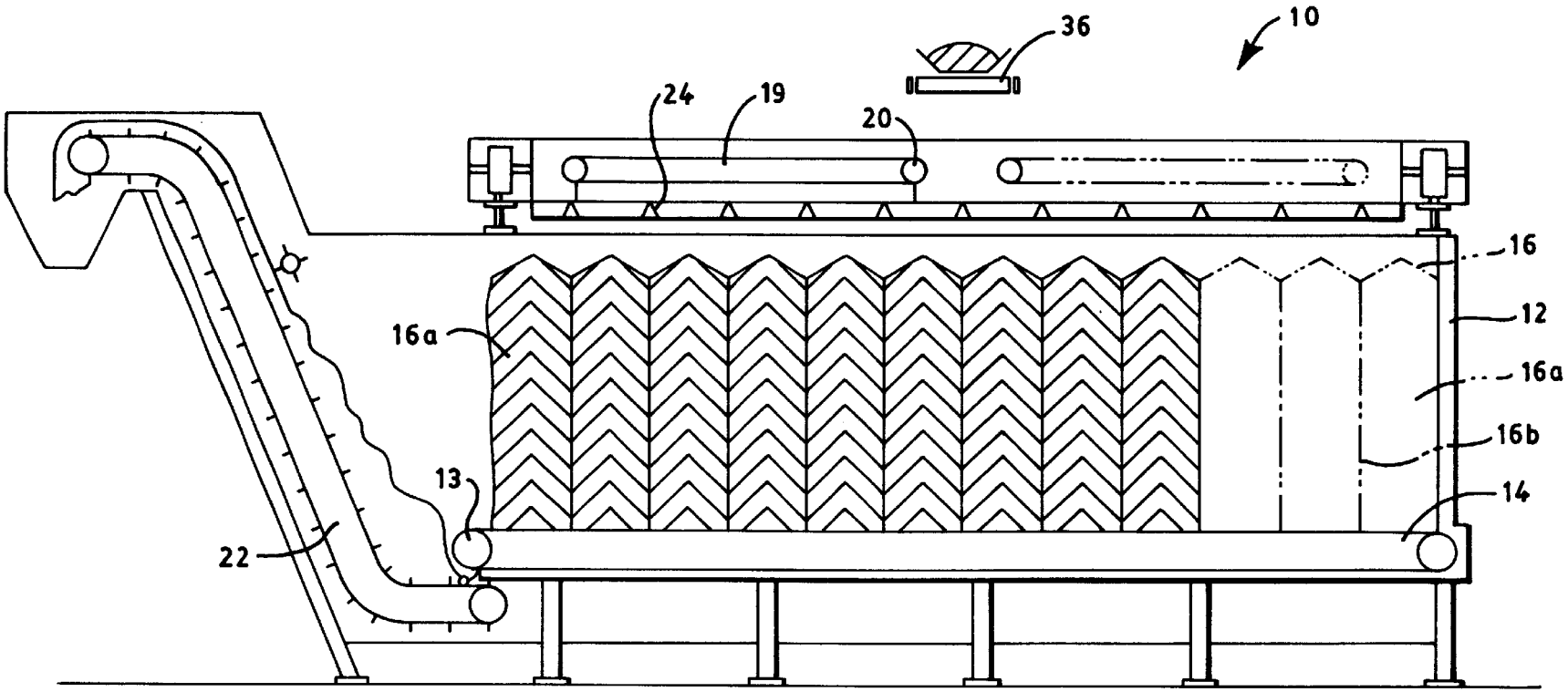
FIG. 1 is a side view of a device for feeding a box for cut ribs and stems with layers of tobacco and FIG. 2 is a perspective view of the horizontal shiftable blending trolley with the separating webs as seen from above.

Referring now to FIG. 1 there is illustrated a blending plant, identified in general by the reference numeral 10, comprising a box 12 for cut ribs and stems which is 15 usually approximately cuboidal and open at the top, the bottom of which is formed by a horizontal conveyor belt 14 so that the horizontal layers of tobacco located in the box 12 for cut ribs and stems, as indicated schematically, are transported out of the open end of the box 12, shown on the left in FIG. 1, and brought to a more or less vertical dispensing conveyor 22 which feeds the cut rib and stem tobacco to further processing.

The box 12 receives the cut ribs and stem tobacco from above by a blending trolley 19 comprising a conveyor belt 18 mounted on rollers 26 in a horizontal frame 28 having rails 29 so that the conveyor belt 18 may be shuttled or reciprocated horizontally in the frame 28. Arranged above the conveyor belt 18, as viewed in the transporting direction of the tobacco, are two rim slats 30 preventing the tobacco from dropping off the side of the conveyor belt 18.

At its two longitudinal ends the frame 28 comprises further rollers 32 running on cross rails 34 so that the complete frame 28 may be shifted at right angles to the direction of movement of the blending trolley 19 and thus shuttled or reciprocated over the width of the box 12 for cut ribs and stems, as a result of which a single, relatively narrow blending trolley is able to feed the total width of the box 12 for cut ribs and stems.

The blending trolley 19 is fed with cut rib and stem tobacco from above by a further conveyor belt 36, indicated schematically in FIG. 1, this conveyor belt being synchronized to the horizontal movement of the blending trolley 19. For this purpose the conveyor belt 36 is, as a rule, included in the movement of the blending trolley 19 horizontally so that continuous feeding of the blending trolley 19 with cut rib and stem tobacco is assured.

From the discharge end 20 of the blending trolley 19 the cut rib and stem tobacco is deposited by free fall into the box 12 for cut ribs and stems where it is stacked in layers, as indicated schematically by the zig-zag lines in FIG. 1, and materialize from the horizontal movement of the blending trolley 19. Each layer contains a specific grade of tobacco furnished by the aforementioned synchronization of the conveyor belt 36 so that it is not until all layers are present that the desired tobacco blend materializes.

The tobacco mass 16 in the box 12 for cut ribs and stems is discharged to the left as shown in the illustration of FIG. 1 and tilts at the discharge end 12 of the conveyor belt 14 to the left to drop onto a near vertical dispensing conveyor 22.

Figure 2:
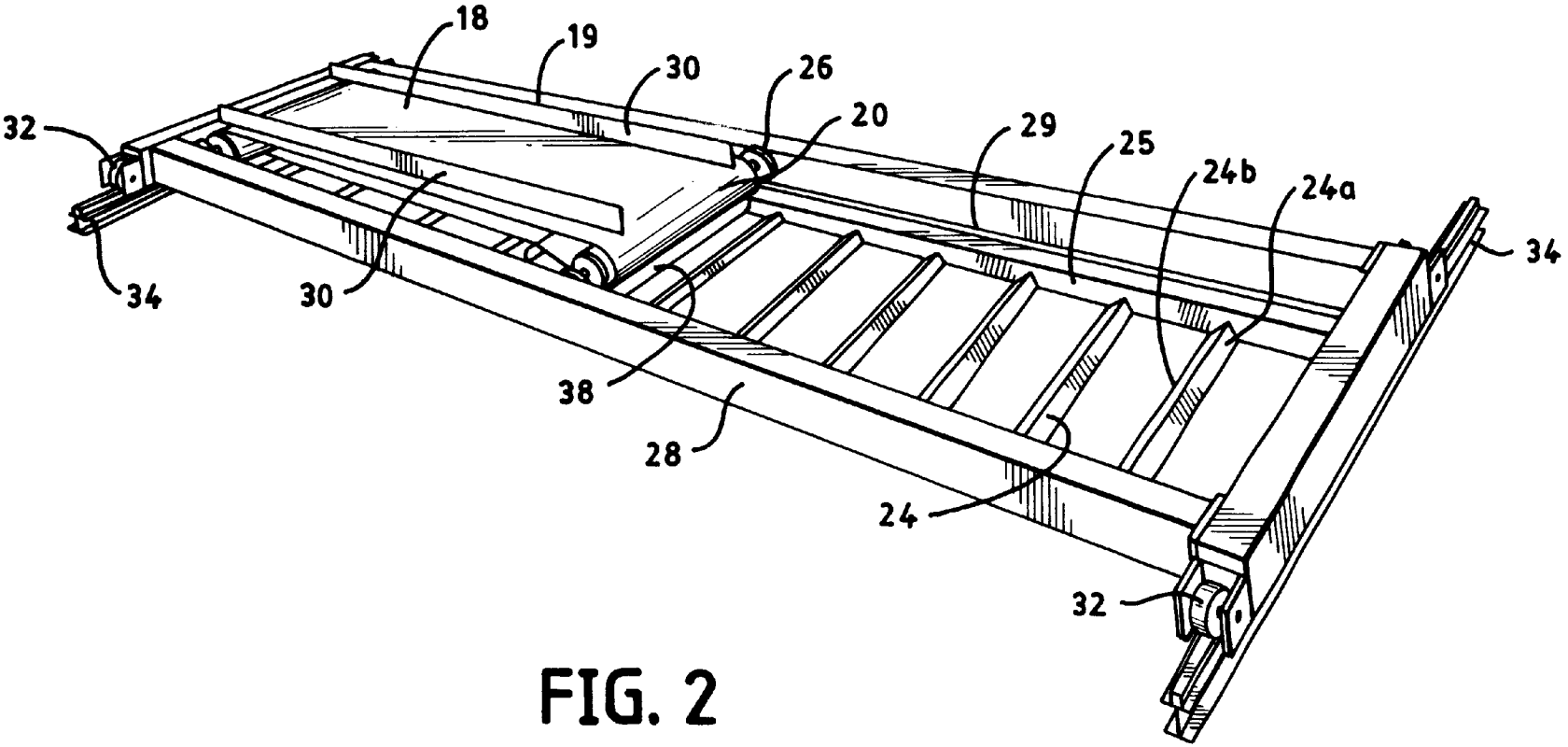

Referring now to FIG. 2 in particular it is evident that horizontal separating webs are provided in the frame 28, these webs being formed by approximately roof-shaped sections 24*a* and 24*b* of sheet metal and extending at right angles to the longitudinal edges of the frame 28 over the full frame opening (see FIG. 2).

When the frame already exists, a ladder-type component having longitudinal edges 25 and webs 24 may be produced as a single unit which is then inserted in the frame 28.

The falling stream of tobacco continually discharged from the discharge end 20 of the blending trolley is "intercepted" by the separating webs 24 so that the stream of tobacco is deflected somewhat by these webs 24, so that the portions of the box 12 for cut ribs and stems located vertically directly below the webs 24 are not directly fed with tobacco.

By slightly shifting the tobacco horizontally as it impacts at the bottom, a compact tobacco mass 16 forms. This is less dense in the regions under the separating 15 webs 24, however, so that the tobacco mass 16 consists of vertical tobacco columns 16*a* which are separated from each other by "predetermined break points" 16*b*, namely regions of less tobacco density below the webs 24.

When the tobacco mass 16 is moved out of the box 12 for cut ribs and stems to the left as shown in FIG. 1, and comes up to the discharge end 13 of the conveyor belt 14 at which the tobacco 16 is tilted to the left and then finally drops off, then the first tobacco column 16*a* separates at these "predetermined break points" 16*b* from the remainder of the tobacco mass and is deposited as a uniform homogenous portion of tobacco on the dispensing conveyor 22 containing tobaccos from all horizontal layers.

Referring now to FIG. 2 it is evident that a blade 38 is applied to the blending trolley 19 below its discharge end 20, this blade sweeping the remaining tobacco from the top edges of the separating webs 24. This blade 38 may be formed by a sweeper plate of sheet metal, this necessitating, however, that the lower edge of the blade 38 is set highly exactly to the upper edge of the webs 24 so that a spacing of approximately 1 mm at the most exists between these two edges to ensure that the tobacco is swept off safely and reliably.

As an alternative to the above arrangements the blade 38 may be formed of a deformable material which strokes the surface of the separating webs 24 to thereby sweep off the remaining tobacco.

The separating webs have a spacing of approximately 30 to 60 cm from each other so that the tobacco columns 16*a* have a corresponding width and the associated homogenous amount of tobacco is deposited on the dispensing conveyor 22.

The separating webs 24 are roof-shaped as viewed from the side, i.e. in the form of an isosceles triangle having a horizontal open underside approximately 120 mm wide. The height of the triangle amounts to approximately 100 mm. With these dimensions the side surface areas of the separating webs 24 form an angle to each other such that the tobacco is able to slide downwards on these surface areas with no problem.

What is claimed is:

1. A method for feeding layers of tobacco to an intermediate reservoir, including a) feeding a continually falling, horizontally shifting stream of tobacco to said intermediate reservoir, wherein b) said falling stream of tobacco is deflected by web-type separators, c) below said web-type separators predetermined break points forming in said tobacco in said intermediate reservoir, forming vertical columns of tobacco separable from each other.

2. A method for forming vertical columns of tobacco in an intermediate reservoir, comprising:

feeding tobacco to a blending trolley from a feeding conveyor;

depositing said tobacco from said blending trolley into a blending box;

wherein a plurality of separating webs below said blending trolley form separable columns of tobacco within said blending box.

3. The method of claim 2 further comprising:

supporting said blending trolley on a horizontal frame;

shuttling said blending trolley along the entire length of said blending box.

4. The method of claim 3 further comprising:

a first and a second side rail forming said frame, wherein said plurality of separating webs extend between said first and second side rail.

5. The method of claim 3 wherein said horizontal frame is movable along a first and a second support end rail of said blending box.

6. The method of claim 5 further comprising:

a first and a second side rail forming said frame, wherein said plurality of separating webs extend between said first and second side rail;

shuttling said blending trolley along said horizontal frame as tobacco is dispensed from said feeding conveyor;

moving said horizontal frame along said first and second support end rail as said blending trolley is shuttled along said horizontal frame.

7. The method of claim 6 wherein said webs are formed by two strips connected to each other and having a triangular cross section.

8. The method of claim 6 further comprising:

sweeping tobacco from said plurality of webs utilizing a sweeping blade on said blending trolley as said blending trolley shuttles on said horizontal frame.

9. The method of claim 6 further comprising:

conveying said tobacco within said blending box by use of a conveyor belt;

dispensing said tobacco from said conveyor belt in said blending box onto a dispensing conveyor.

10. The method of claim 9 further comprising retaining said tobacco on said dispensing conveyor by utilizing a plurality of outwardly extending spikes on said dispensing conveyor.

11. A method for forming vertical columns of tobacco in an intermediate reservoir, comprising:

feeding a continually falling shifting stream of tobacco to a blending trolley from a feeding conveyor;

depositing said tobacco from said blending trolley into a blending box;

deflecting said falling stream of tobacco by a plurality of separating webs;

forming a plurality of vertical columns of tobacco within said blending box, each of said vertical columns separable from each other.

* * * * *